United States Patent [19]

Gösslinghoff

[11] Patent Number: 5,002,456

[45] Date of Patent: Mar. 26, 1991

[54] PROCESS AND APPARATUS FOR FORMING STACKS OF FOLDED PRINTING PRODUCTS

[75] Inventor: Reinhard Gösslinghoff, Wetzikon, Switzerland

[73] Assignee: Ferag AG, Hinwil, Switzerland

[21] Appl. No.: 371,049

[22] Filed: Jun. 26, 1989

[30] Foreign Application Priority Data

Jun. 27, 1988 [CH] Switzerland ..... 02444/88

[51] Int. Cl.[5] ..... B65G 57/00

[52] U.S. Cl. ..... 414/788.3; 414/791; 414/792.2; 414/907; 271/218

[58] Field of Search ..... 271/217, 218, 220, 221; 414/788.9, 790.9, 791, 791.6, 792, 792.2, 792.3, 794.2, 788.3, 907

[56] References Cited

U.S. PATENT DOCUMENTS

| | | | |
|---|---|---|---|
| 3,379,320 | 4/1968 | Loach et al. | 414/788.3 |
| 3,507,492 | 4/1970 | Spencer | 271/188 |
| 4,183,704 | 1/1980 | Steinhart | 414/788.3 |
| 4,547,112 | 10/1985 | Steinhart | 414/792.2 X |
| 4,720,229 | 1/1988 | Steinhart | 414/788.3 X |

FOREIGN PATENT DOCUMENTS

| | | | |
|---|---|---|---|
| 1918442 | 4/1969 | Fed. Rep. of Germany . | |
| 2357658 | 5/1975 | Fed. Rep. of Germany | 271/218 |
| 0243764 | 10/1986 | Japan | 414/788.3 |

*Primary Examiner*—Frank E. Werner
*Assistant Examiner*—James T. Eller, Jr.
*Attorney, Agent, or Firm*—Fleit, Jacobson, Cohn, Price, Holman & Stern

[57] ABSTRACT

A stacking apparatus includes a stacking unit and a bundling unit arranged under the stacking unit. Located at the end of a prestacking space, as seen in the direction (F), is a limiting element which serves as a stop for the folds of the printing products. While the printing products fed, with their fold forward, in the feed direction (F) are being deposited on one another to form a prestack, they are supported approximately centrally by a supporting element in their edge region located opposite the fold. For depositing the prestack so formed onto a rest table, supporting arms are pivoted into a position of rest and slide plates are moved out of the region of the stacking space. A residual bend of the printing products is thus preserved in their edge region, thereby improving the stability of the stack.

9 Claims, 5 Drawing Sheets

PROCESS AND APPARATUS FOR FORMING STACKS OF FOLDED PRINTING PRODUCTS

FIELD OF THE INVENTION

The present invention relates to a process and an apparatus for forming stacks of folded printing products.

BACKGROUND OF THE INVENTION

An apparatus for stacking folded printing products is known from Swiss Patent Specification 623,287 or the corresponding U.S. Pat. No. 4,229,134. These references disclose a conveyor device, by means of which printing products are conveyed up against limiting fences of a prestacking space. The prestacking space is limited at the bottom by two slide plates, on which the printing products are deposited on top of one another to make prestacks, each formed from a number of printing products. Underneath the prestacking space there is a rest table which is equipped with a lifting and lowering device and which is pivotable respectively through 180° about a vertical axis.

A first prestack formed in the prestacking space is deposited onto the rest table, lifted to a little below the slide plates, by moving the slide plates apart from one another. The rest table is subsequently lowered by the amount of approximately the height of the prestack, and to form a further prestack the slide plates are pushed against one another again. The rest table is pivoted through 180° about the vertical axis and subsequently lifted towards the slide plates, so that the printing products of the first prestack are pressed, in order to form an essentially horizontal rest for the next prestack. The rest table is now lowered again, until a small gap forms between the first prestack and the slide plates arranged above it. As soon as the second prestack is ready in the prestacking space, the slide plates are opened again and the second prestack is deposited onto the first prestack rotated through 180°.

The rest table is now lowered once more, the slide plates are closed, and the two prestacks lying above one another are pressed against the slide plates as a result of the lifting of the rest table. This operation is repeated until a pressed finished stack composed of a specific number of prestacks arranged above one another lies on the rest table. With this known apparatus, although printing products can be laid on top of one another to form finished stacks having the necessary stability to be transported away, this nevertheless requires a specific processing time.

An apparatus for the stacking of printing products fed with their fold forward is know from U.S. Pat. No. 3,507,492, and in this rests are arranged on a revolving pulling member and are moved from the top downwards past the exit end of the conveyor device. Each rest is composed of parallel L-shaped brackets, one leg of each of which forms a stop for the folds of the printing products. The particular bracket located in the middle has, on its other leg inclined slightly relative to the horizontal, a rest element which is raised in relation to the legs of the other brackets. The first printing products deposited on the rest in succession are thus bent slightly in a roof-shaped manner.

During the lowering of the rest, the bottommost printing product comes to rest, with its edge region located opposite the fold, approximately centrally on a supporting element of fixed location, the roof-shaped bend becoming more pronounced in order to prevent the printing products from collapsing. The associated lifting of the edge regions opposite the folds guarantees that the folds bear firmly against the stop. During the further movement of the rest, each printing product is still supported only at its ends on the fold and at the edge located opposite this. The pronounced bending of the printing products prevents them from collapsing as a result of the pressure forces which are considerable with this type of support. When the printing products run off from the supporting element, each printing product is released individually at its edge located opposite the fold, so that, with the pronounced bend being cancelled, it can swing down again onto the brackets or onto the printing products already lying on them. During the further lowering of the rest, the finished stack passes onto a roller conveyor, by means of which it is conveyed away. With this known apparatus, stacks aligned on the same side as the folds can certainly be formed. But the stack height is restricted, since no further measures at all are taken to give the stack greater stability for transporting away. Thus, with this apparatus it is impossible to eliminate the larger thickness of the printing products in the region of the folds by the pressing of part stacks and/or by stacking these on one another so that they are rotated 180° relative to one another. The bend of the printing products is also cancelled again for transporting them away.

SUMMARY OF THE INVENTION

The object of the present invention is, therefore, to provide a process and an apparatus, by means of which folded printing products can be stacked to form highly stable finished stacks of high quality within a shorter processing time.

The printing products are conveyed, with their fold forward, up against a stop of the prestacking space. At the same time, during the stacking in the prestacking space, at least the printing products forming the uppermost prestack of the finished stack are supported by a supporting element approximately centrally solely in the edge region located opposite the fold, specifically in such a way that this edge region comes to rest at least at the same height as and preferably higher than the opposite fold. The result of this is that the printing products come to bear on the stop with their fold and an exactly aligned prestack is thus formed; this is achieved even when the layer of the uppermost printing products of the prestack comes near to a horizontal plane because of the larger thickness of the folded printing products in the region of the fold. Since the particular bottommost printing product is supported only approximately centrally in the edge region located opposite the fold, the unsupported parts of the edge region bend downwards arcuately or in the same manner of a ridge roof on both sides of the supporting element. As a result of this, the printing products assume approximately the form of the surface of a half-pyramid. This gives the prestack a specially high stability, so that the printing products cannot slide off in the direction of the fold.

When such a prestack is being deposited onto the rest table or onto the printing products already present there, at least a residual bend of the printing products of the prestack is preserved. This gives the uppermost part stack of a finished stack sufficient stability to ensure that the finished stack can be conveyed away from the rest table, even without this part stack last deposited being pressed, nonetheless with no danger that the finished stack will fall apart.

BRIEF DESCRIPTION OF THE DRAWINGS

The invention is now described in detail by means of an exemplary embodiment illustrated in the drawing. In the purely diagrammatic drawing.

DETAILED DESCRIPTION OF THE PREFERRED EMBODIMENTS

Figure 1:
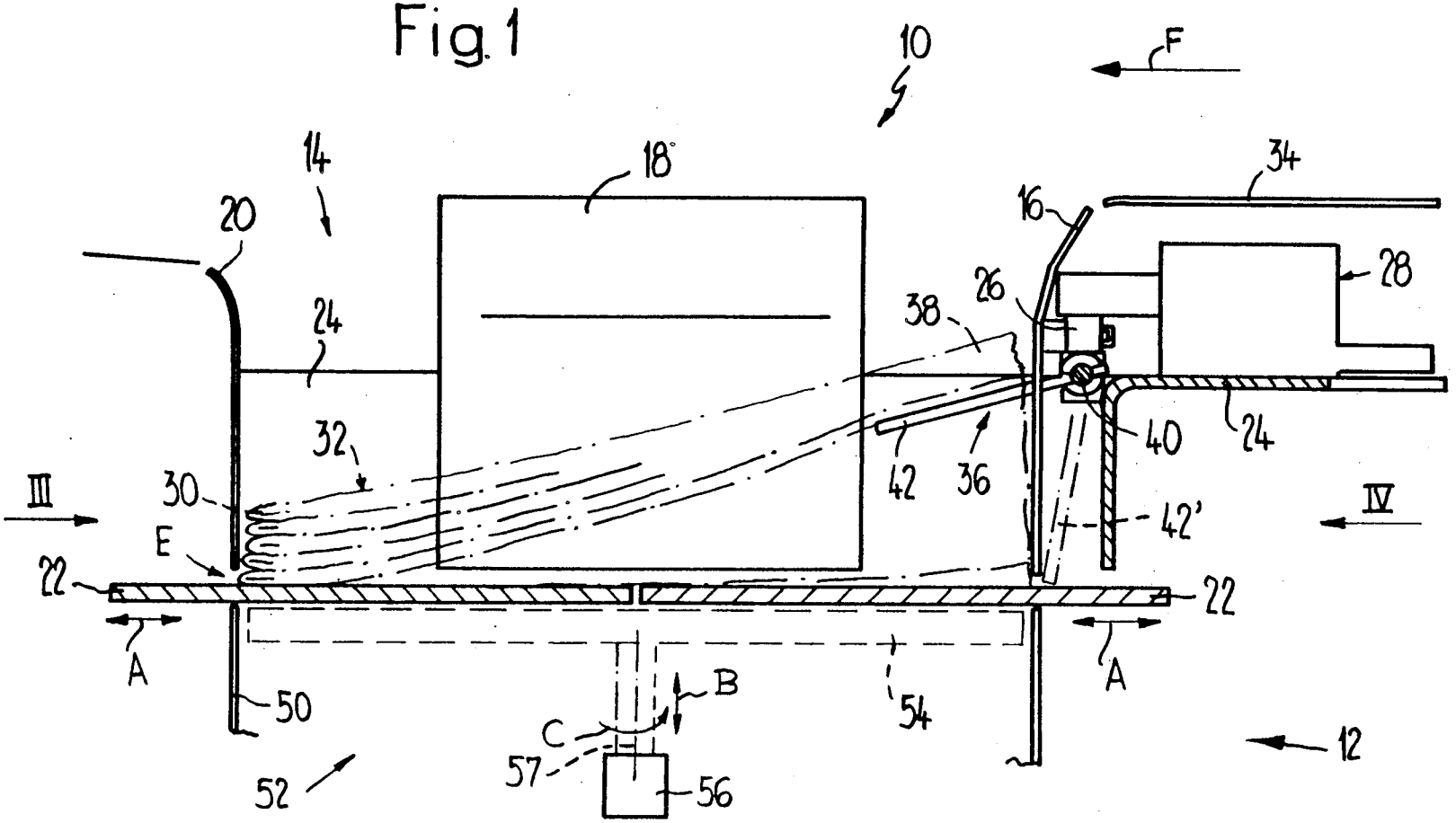
FIG. 1 shows a vertical section through part of a stacking apparatus.
Figure 2:
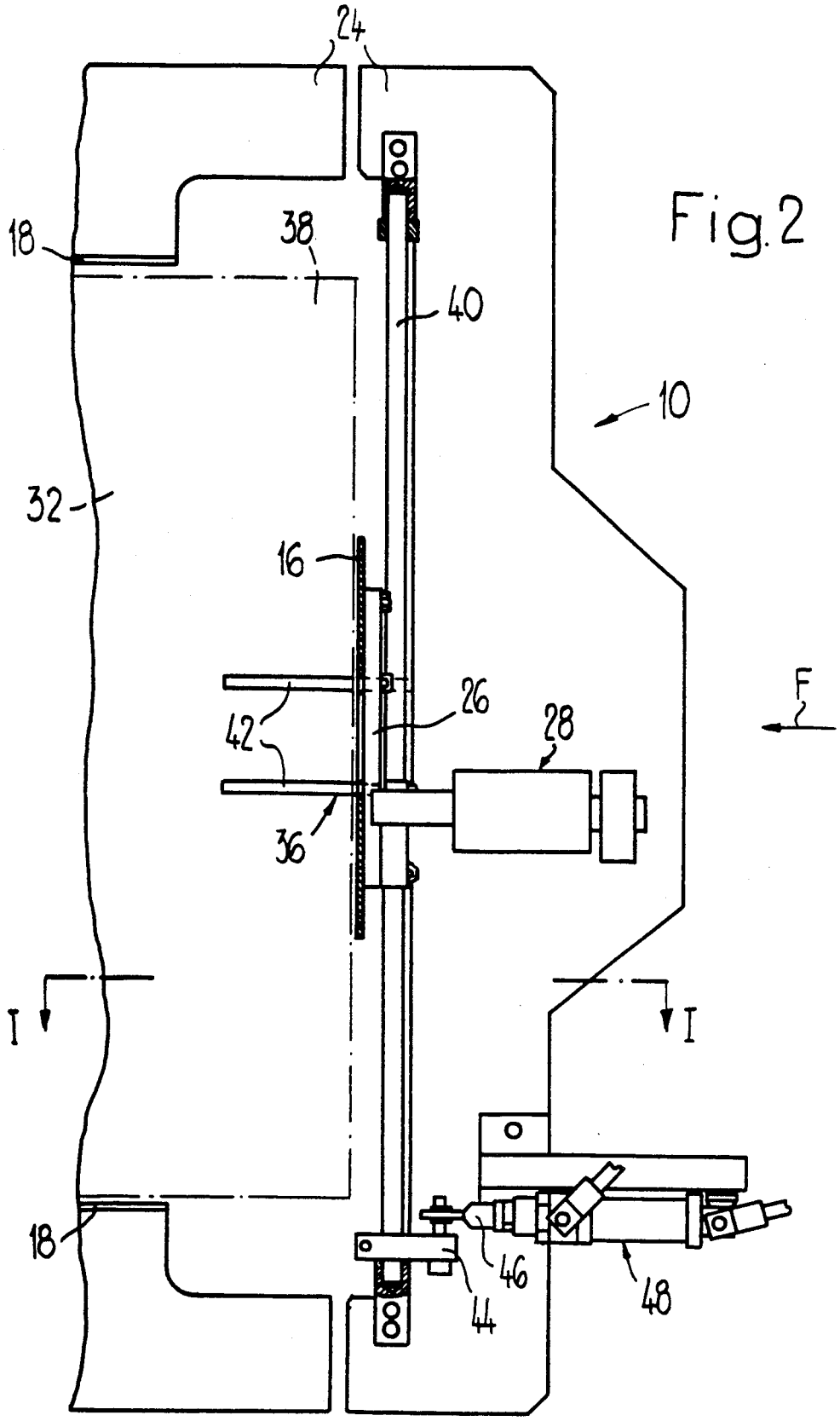
FIG. 2 shows a top view of part of a stacking apparatus according to FIG. 1.

FIGS. 1 and 2 illustrate part of a stacking apparatus in simplified form, FIG. 1 showing a vertical section along the line I—I of FIG. 2. The stacking apparatus has a stacking unit 10 and a bundling unit 12 arranged under the stacking unit. An upwardly open prestacking space 14 of the stacking unit 12 is limited laterally by limiting elements 16, 18, 20 and at the bottom by two slide plates 22 movable in the direction of the double arrows A, that is to say in the product feed direction F, into the region of the prestacking space 14 and out of this.

The limiting elements 18, provided on the right and left, as seen in the direction of the arrow F, and the limiting element 20 located at the end of the prestacking space 14 are secured to a frame 24 indicated diagrammatically, whilst the limited element 16 provided at the start of the prestacking space 14 is arranged on a boom 26, displaceable in and counter to the direction of the arrow F, of an adjusting device 28 likewise fastened to the frame 24. The limiting element 20 serves as a stop for the folds 30 of the printing products 32 fed in the feed direction F, with their folds 30 forward, and represented by dot-and-dash lines (see especially FIG. 1). The prestacking space 14 can be matched to the format of the printing products 32 by means of the adjusting device 28. A guide plate of a conveyor device, not shown in detail in FIGS. 1 and 2, for feeding the printing products 32 in designated by 34.

In the initial region of the prestacking space 14, there is a supporting element 36 for supporting the printing products 32 solely in the edge region 38 located opposite the fold. This supporting element 36 has a pivoting shaft 40 which is mounted pivotably on the frame 24 and is arranged approximately centrally between the slide plates 22 and the guide plate 34 and which precedes the limiting element 16, as seen in the feed direction F, and is arranged at a distance above the slide plates 22, and the horizontal pivot axis of which extends at right angles to the feed direction F.

Two mutually parallel supporting arms 42 spaced apart from one another in the direction of the pivot axis are secured approximately centrally on the pivoting shaft 40 fixedly in terms of rotation, and arranged fixedly in terms of rotation on the pivoting shaft 40 is a drive lever 44, the free end of which is connected operatively to the push rod 46 of a piston/cylinder unit. In the region of the supporting arms 42, the limiting element 16 has recesses, not visible in FIGS. 1 and 2, by means of which the supporting arms 42 are pivotable by means of the piston/cylinder unit 48 out of their downwardly directed position of rest designated by 42' into the supporting position represented by unbroken lines and back again.

As shown in FIG. 1, in their position of rest the supporting arms 42 are located behind the limiting element 16, that is to say outside the prestacking space 14. In the supporting position, the supporting arms 42 project into the stacking space 14 and at the same time are directed approximately towards the corner E defined by the limiting wall 20 and the slide plate 22 located on the left in FIG. 1. However, it is also conceivable to have an arrangement of the supporting arms 42 in which, in the supporting position, these project virtually horizontally into the prestacking space 14.

The bundling unit 12 has a receiving shaft 52 which is indicated diagrammatically by means of guide fences 50 and in which a rest table 54, represented by broken lines, is displaceable in the direction of the arrow B by means of a lifting and lowering device 56. Furthermore, there is a rotary device, represented by the double arrow C, by means of which the rest table 54 is pivotable respectively to and fro through 180° about a vertical axis 57. Such lifting and lowering devices 56 and rotary devices are generally known and are described in detail, for example, in Swiss Patent Specification 623,287 or the corresponding U.S. Pat. No. 4,229,134.

Figure 3:
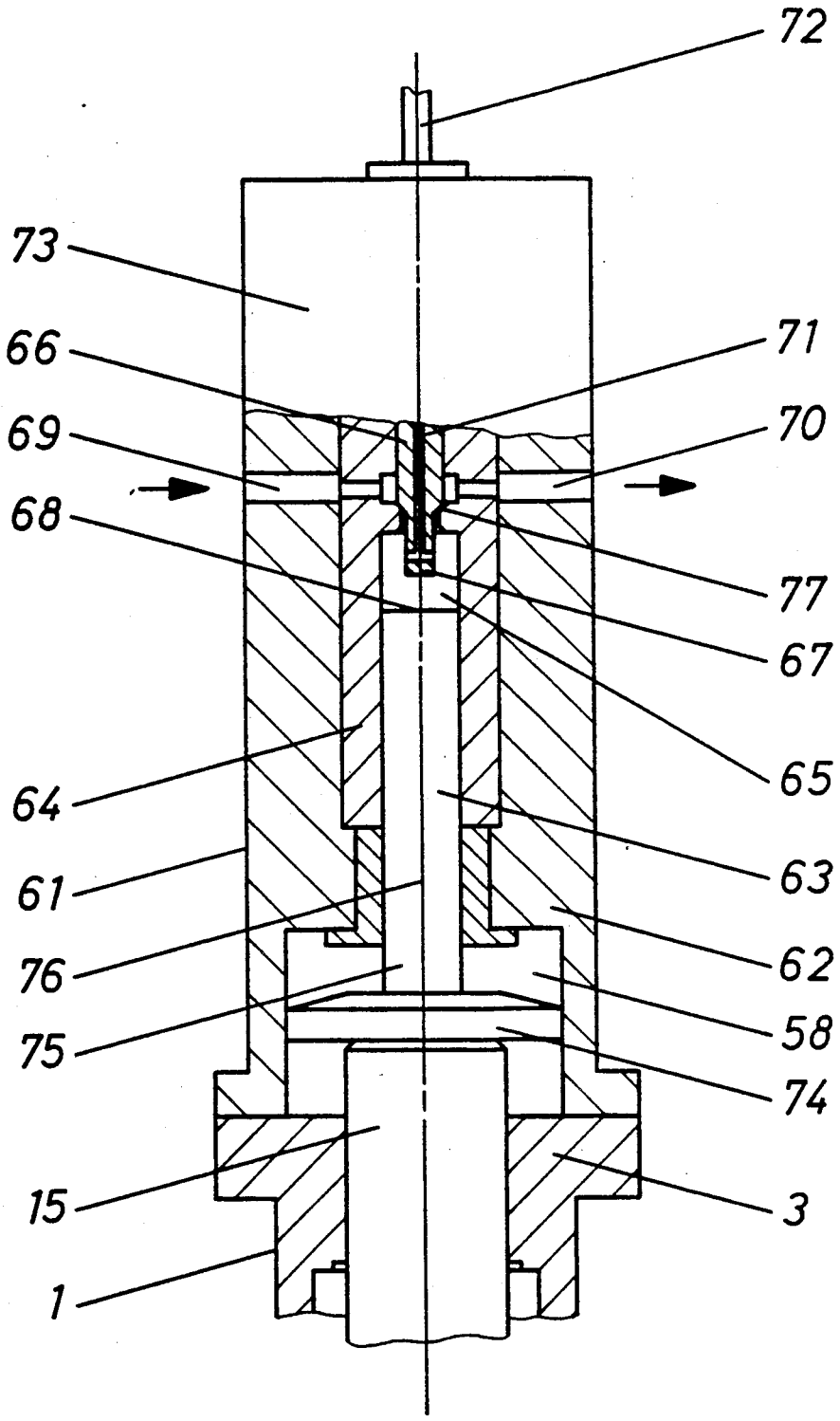
FIGS. 3 and 4 show a side view respectively in the direction of the arrows III and IV of FIG. 1 of part of a stacking apparatus in a simplified representation.
Figure 4:
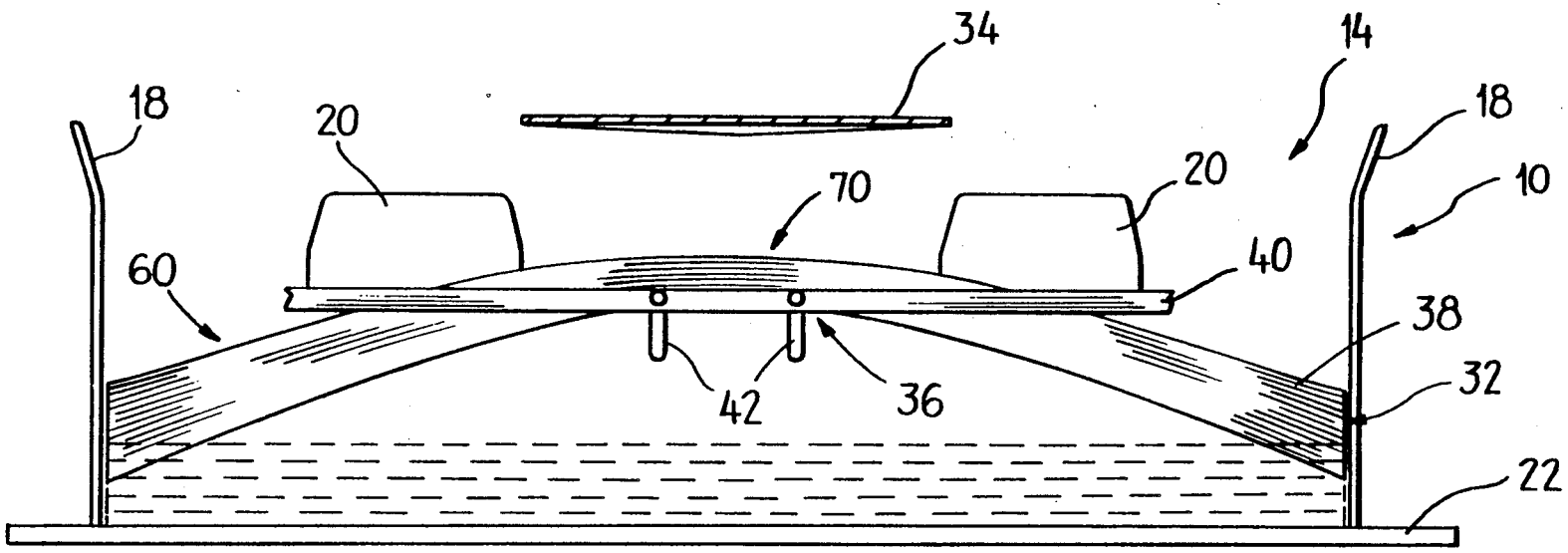

FIGS. 3 and 4 show side views of the stacking unit 10 respectively in the direction of the arrows III and IV of FIG. 1, the limiting elements 20, 16 which precede the prestacking space 14, as seen in the direction of the corresponding arrow. The supporting arms 42 fastened to the pivoting shaft 40, shown truncated, are illustrated in their supporting position, in which they project with their free end regions into the prestacking space 14 through the recesses 58 in the limiting element 16 (see FIG. 3). The bottommost printing product 32 lies, in the region of its fold 30, on the slide plate 22 distant from the supporting element 36 (see also FIG. 1) and is supported approximately centrally by the supporting arms 42 in its edge region 38 located opposite the fold 30. This bottommost printing product 32, together with the printing products 32 deposited on it, form a prestack 60.

Those parts of the edge regions 38 of the printing products 32 which project laterally relative to the supporting arms 42 are bent downwards as a result of their own weight. They thereby assume virtually the form of the surface of a half-pyramid, with the result that the printing products 32 are substantially reinforced. As can be seen especially well in FIGS. 3 and 4, the limiting elements 18 limit the stacking space 14 on the right and left. The guide plate of the conveyor device is designated by 34.

Figure 5A:
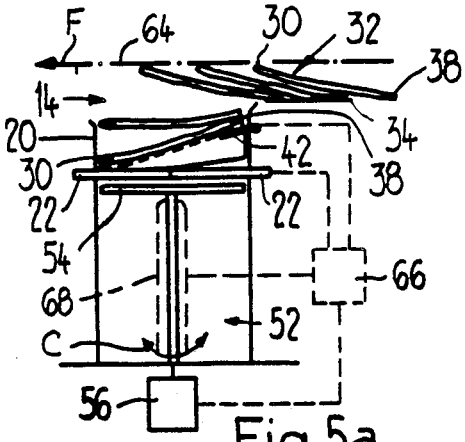
FIGS. 5*a* to 5*h* show a greatly simplified representation of the stacking apparatus according to FIGS. 1 to 4 at different moments during the formation of a stack in front view and side view.
Figure 5B:
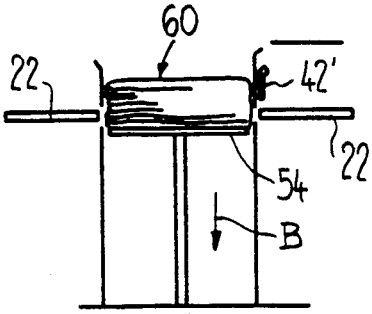
Figure 5C:
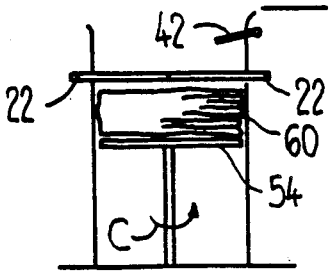
Figure 5D:
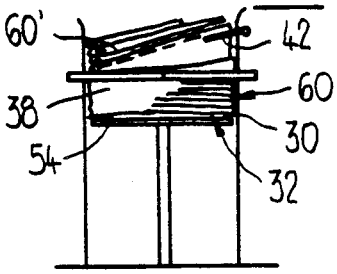
Figure 5E:
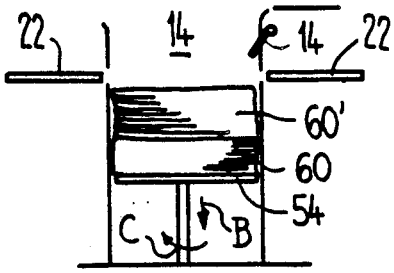
Figure 5F:
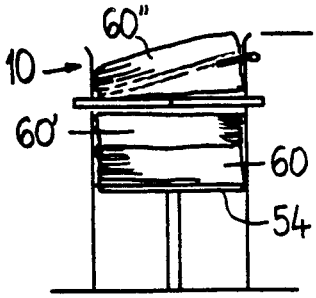
Figure 5G:
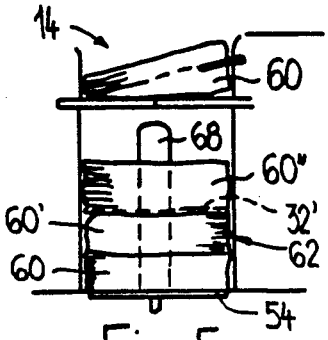
Figure 5H:
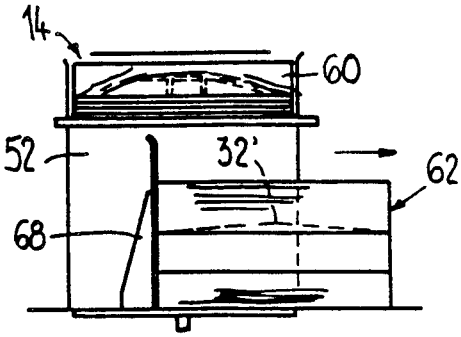

The entire stacking apparatus is shown in greatly simplified form in a front view in FIGS. 5*a* to 5*g* and in a side view in FIG. 5*h* at different moments during the formation of a finished stack 62 illustrated in FIGS. 5*g* and *h*. In FIG. 5*a*, the conveyor device 64 for feeding the printing products 32 to the prestacking space 14 in the feed direction F is represented by a dot-and-dash line. This conveyor device 64 has a revolving pulling member, not shown in detail, with individually controllable grippers arranged on it in succession at a fixed distance from one another, as is known, for example, from EP-Bl 0,059,746 or the corresponding U.S. Pat. No. 4,666,143. Each gripper holds a printing product 32 at its fold 30 leading, as seen in the feed direction F, the trailing edge region 38 sliding over the guide plate 34 preceding the prestacking space 14. Above the prestacking space 14, the respective gripper of the conveyor device 64 is opened, with the result that the particular printing product 32 falls, with its fold 30 forward, against the limiting element 20.

As indicated symbolically by broken lines, a control device 66 controls the pivoting movement of the supporting arms 42, the movement of the slide plates 22 out of and into the region of the prestacking space 14, the lifting and lowering device 56 and rotary device for the rest table 54, and an ejection member 68 for ejecting the finished stack 62 from the receiving shaft 52. The ejection member 68 is described in detail in Swiss Patent Specification 623, 281 or the corresponding U.S. Pat. No. 4,229,134.

In FIG. 5*a*, the supporting arms 42 are in their supporting position, the slide plates 22 are moved into the prestacking space 14 and the rest table 54 is lifted into its upper end position, in which only a narrow gap is free between the resting surface of the rest table 54 and that of the underside of the slide plates 22. The first printing product 32 introduced into the prestacking space 14 lies with its fold region 30 on a slide plate 22 and is supported centrally in the edge region 38 by the supporting arms 42. The further printing products 32 fed by the conveyor device 64 fall onto the printing products 32 already located in the prestacking space 14 and are stacked to form a prestack 60 with a specific number of printing products 32 (see FIG. 5*b*).

As soon as a complete prestack 60 is formed, the supporting arms 42 are pivoted into their position of rest 42' and the slides 22 are moved out of the region of the prestacking space 14 in the direction of the arrow A (FIG. 1), that is to say essentially in the same direction as the bending line 70 (FIGS. 3 and 4), with the result that the prestack 60 falls onto the rest table 54. Since the falling height is very small and there is a certain friction or adhesion between the individual printing products 32 in the prestack 60, an upwardly directed approximately central bend of the printing products 30 is preserved in their edge region 38 and is not influenced by the opening of the slide plates.

Subsequently, the rest table 54 is lowered, as indicated by the arrow B in FIG. 5*b*, until the upper end of the prestack 60 comes to rest below the slide plates 22 (see FIG. 5*c*). Then, simultaneously, the rest table 54, together with the prestack 60 arranged on it, are rotated through 180° in the direction of the arrow C, the two slide plates 22 are moved towards one another again into the prestacking space 14, and the supporting arms 42 are pivoted into their supporting position.

Now, as described further above and as indicated in FIG. 5*d*, a further prestack 60' is formed in the prestacking space 14, whilst the first prestack 60 is pressed together between the rest table 54 and the slide plates 22 as a result of the lifting of the rest table 54. The result of this pressing together is that the residual bend in the printing products 32 in the edge region 38 and the large thickness in the region of the folds 30 are cancelled.

The rest table 54 is thereafter lowered until a small gap forms between the upper end of the prestack 60 and the underside of the slide plates 22. As soon as sufficient printing products 32 are deposited on top of one another in the prestacking space 14 to form the second prestack 60', the supporting arms 42 are once again pivoted into their position of rest 42' and the slide plates 22 are moved out, as a result of which the second prestack 60' falls onto the first prestack 60; these two prestacks 60, 60' are now rotated through 180° relative to one another.

As shown in FIG. 5*e*, the rest table 54 is subsequently lowered in the direction of the arrow B, until the upper end of the second prestack 60' comes to rest below the two slide plates 22, and is thereafter rotated through 180° in the direction of the arrow C, that is to say in the opposite direction. By pushing the two slide plates 22 into the prestacking space 14 once again and by transferring the supporting arms 42 into their supporting position, the stacking unit 10 is ready for forming a further prestack 60'' (see FIG. 5*f* in this respect). The two prestacks 60, 60' lying on top of one another are now pressed together as a result of the lifting of the rest table 54, so that the upper end of the prestack 60' constitutes an essentially horizontal rest for the third prestack 60''. The rest table 54 is subsequently lowered for receiving the third prestack 60'', as illustrated in FIG. 5*f*. After the third prestack 60'' has been deposited on the second prestack 60', the rest table 54 is lowered completely, without the finished stack 62 composed of three prestacks 60, 60', 60'' having been previously pressed together (see FIG. 5*g*). The residual bend of the printing products 32 of the uppermost prestack 60'' is thus preserved, as indicated by a broken line 32' (see FIG. 5*h* also in this respect). While the ejection member 68 is ejecting the finished stack 62 out of the receiving shaft 52, a new first prestack 60 is already being formed again in the prestacking space 14 in the known way.

Since a residual bend is preserved, at least in the bottommost printing product 32 of the uppermost prestack 60', when the supporting arms 42 are being pivoted back into their position of rest 42' and the prestack 60'' is being deposited on the prestack 60', the larger thickness of the printing products 32 in the region of the folds 30 is compensated and the printing products 32 are prevented from slipping off from the finished stack 62. It is thus possible to avoid pressing the finished stack 62, this entailing a considerable reduction in the processing time.

It is also conceivable not to rotate the rest table 54 through 180° each time, with the result that the folds 30 of all the printing products 32 are located on top of one another in the finished stack 62. It is also possible, when the printing products 32 are being laid on top of one another in the prestacking space 14 to form the prestacks 60, 60' located at the bottom in the finished stack 62, for the supporting arms 42 to remain in their position of rest 42' and for the particular bottommost printing product 32 therefore to come to rest with its entire underside on the slide plates 22. However, this does not guarantee that the folds 30 will bear firmly against the limiting element 20, and the result of this can be that printing products 32 do not lie on top of one another exactly in line. At all events, the printing products 32, which are stacked on one another to form the uppermost prestack 60' of the finished stack 62, are always supported by means of the supporting arms 42.

I claim:

1. An apparatus for forming stacks of folded printing products, such as newspapers and periodicals, said apparatus comprising:

a prestacking space for stacking of printing products, a stop located at an end of the prestacking space, a conveyor device for feeding a series of printing products, with a side edge forward, up against the stop of the prestacking space, in which prestacks are formed, each prestack being formed from a specific number of printing products, a rest member located below the prestacking space, onto which the prestacks are deposited on one another, a press device cooperating with the rest member for pressing together prestacks laid onto the rest member, a discharge conveyor for guiding the finished stacks formed from at least two prestacks on the rest member away from the rest member, a supporting element introducible into the prestacking space and withdrawable again from the prestacking space being provided to ensure that the printing products of at least the uppermost prestack of the finished stack, conveyed with their fold forward up against the stop, are supported by the supporting element approximately centrally only in the edge region of the printing products located opposite the fold of the printing products, and the finished being guided away by means of the discharge conveyor, without the upper most prestack previously being pressed, the supporting element having a supporting member mounted pivotably about an essentially horizontal axle extending transversely relative to a feed direction of the printing products and preceding the prestacking space and the supporting element being pivotable downwards from a supporting position pointing into the stacking space into a position of rest and back again, the supporting member being arranged outside the prestacking space in its position of rest.

2. An apparatus as claimed in claim 1, wherein the supporting member has a supporting lever with two supporting arms spaced laterally from one another and essentially parallel to one another.

3. An apparatus as claimed in claim 1, wherein the rest member is pivotable through 180° about an essentially vertical axis, respectively in opposite directions.

4. An apparatus as claimed in claim 1, wherein the prestacking space is arranged directly above the rest member and is limited at the bottom by a closing member movable out of the region of the prestacking space and into the prestacking space again.

5. An apparatus as claimed in claim 4, wherein the closing member is formed by at least one essentially horizontal slide plate displaceable parallel to the feed direction.

6. An apparatus as claimed in claim 4, wherein the rest member is equipped with a lifting and lowering device and together with the closing member forms the press device.

7. An apparatus as claimed in claim 4, wherein the supporting element is arranged at a distance above the closing member.

8. An apparatus as claimed in claim 4, wherein the closing member is movable into and out of the prestacking space in a direction essentially parallel with the feed direction of the printing products.

9. An apparatus as claimed in claim 1, wherein, in the supporting position, the supporting element is directed essentially towards a corner formed by the closing member and the stop of the prestacking space.

* * * * *